US008128387B2

(12) United States Patent
Stehouwer et al.

(10) Patent No.: US 8,128,387 B2
(45) Date of Patent: Mar. 6, 2012

(54) DISCHARGE CHAMBER FOR DUAL DRIVE SCROLL COMPRESSOR

(75) Inventors: Rance Andrew Stehouwer, Ann Arbor, MI (US); Kanwal Bhatia, Canton, MI (US); Michael Gregory Theodore, Plymouth, MI (US); Nuno Alexandre Guerin, Cascais (PT)

(73) Assignee: Visteon Global Technologies, Inc., Van Buren Township, MI (US)

( * ) Notice: Subject to any disclaimer, the term of this patent is extended or adjusted under 35 U.S.C. 154(b) by 865 days.

(21) Appl. No.: 12/056,031

(22) Filed: Mar. 26, 2008

(65) Prior Publication Data

US 2009/0246055 A1 Oct. 1, 2009

(51) Int. Cl.

| | |
|---|---|
| ***F01C 1/02*** | (2006.01) |
| ***F01C 1/063*** | (2006.01) |
| ***F03C 2/00*** | (2006.01) |

(52) U.S. Cl. ..... 418/55.1; 418/60; 418/270; 417/312

(58) Field of Classification Search ..... 418/55.1–55.6, 418/57, 270, 3, 58–60; 417/362, 374
See application file for complete search history.

(56) References Cited

U.S. PATENT DOCUMENTS

| | | | | |
|---|---|---|---|---|
| 5,186,614 | A * | 2/1993 | Abousabha | 417/312 |
| 6,543,243 | B2 | 4/2003 | Mohrmann et al. | |
| 7,278,833 | B2 | 10/2007 | Higashiyama et al. | |
| 2009/0173095 | A1 * | 7/2009 | Bhatia et al. | 418/55.6 |

FOREIGN PATENT DOCUMENTS

| | | | |
|---|---|---|---|
| JP | 2003269331 | A2 | 9/2003 |
| JP | 2004278388 | A * | 10/2004 |
| JP | 2005188431 | A * | 7/2005 |
| JP | 2005248789 | A * | 9/2005 |

* cited by examiner

*Primary Examiner* — Theresa Trieu
(74) *Attorney, Agent, or Firm* — Fraser Clemens Martin & Miller LLC; J. Douglas Miller

(57) ABSTRACT

A dual drive compressor is disclosed including a discharge chamber having a wall disposed therein forming a plurality of discharge zones within the discharge chamber to attenuate pulsations caused by a fluid received in the compressor and improve a performance of the compressor.

20 Claims, 3 Drawing Sheets

DISCHARGE CHAMBER FOR DUAL DRIVE SCROLL COMPRESSOR

FIELD OF THE INVENTION

The invention relates to a compressor and more particularly to a dual drive scroll compressor including a discharge chamber for receiving a compressed fluid from a mechanically driven compressor assembly an electrically driven compressor assembly, the discharge chamber including a wall section disposed therein adapted to militate against fluid discharge event interactions between the mechanically and electrically driven compressor assemblies.

BACKGROUND OF THE INVENTION

Hybrid electric vehicles having improved fuel economy over internal combustion engine powered vehicles and other vehicles are quickly becoming more popular as a cost of fuel increases. Typically, the improved fuel economy is due to known technologies such as regenerative braking, electric motor assist, and engine-off operation.

Although the technologies improve fuel economy, there are drawbacks. One such drawback is that accessories powered by a fuel-powered engine no longer operate when the fuel-powered engine is not in operation. One major accessory that does not operate is an air-conditioning compressor, which helps to cool air in a passenger compartment of the vehicle. Ultimately, without the use of the compressor, the temperature of the air in the passenger compartment increases to a point above a desired set-point, and the fuel-powered engine of the vehicle must restart.

Accordingly, vehicle manufacturers have used a full electric compressor on hybrid vehicles. The full electric compressor operates whether the fuel-powered engine is operating or not. A significant disadvantage of the full electric compressor is the inefficiency that occurs from converting engine shaft power to electricity, then electricity back to compressor shaft power. Thus, the use of a hybrid compressor which is mechanically and electrically driven is advantageous.

One such hybrid compressor is described in U.S. Pat. No. 6,543,243 entitled HYBRID COMPRESSOR, hereby incorporated herein by reference in its entirety. The compressor includes two compressor assemblies inside a single housing which operate independently of each other. One of the assemblies is mechanically driven by a pulley system in mechanical communication with a fuel-powered engine of the vehicle. The other of the assemblies is electrically driven and can be used when the fuel-powered engine is off, or when an excess of battery power is present. Therefore, it is possible to operate the compressor at maximum efficiency without impacting the temperature of the passenger compartment of the vehicle.

Although the aforementioned hybrid compressors operate efficiently, the compressors are difficult to package in an existing single compressor envelope, and involve high manufacturing costs. Additionally, because each assembly typically discharges a compressed fluid to a common discharge chamber, the operation of one assembly can interfere with the operation of the other assembly. Flow interference between the fluids discharged from the respective assemblies reduces the operating efficiency of the compressor and increases a noise generated thereby that is perceptible by passengers of the vehicle. The reduced operating efficiency necessitates the use of a larger compressor to achieve a desired output of compressed fluid therefrom.

Accordingly, it would be desirable to produce a discharge chamber for a compressor, wherein an interference of discharge pulsations, a cost, and a space requirement thereof are minimized and an efficiency thereof is maximized.

SUMMARY OF THE INVENTION

Compatible and attuned with the present invention, a discharge chamber for a compressor, wherein an interference of discharge pulsations, a cost, and a space requirement thereof are minimized and an efficiency thereof is maximized, has been discovered.

In one embodiment, the compressor comprises a housing having a discharge chamber formed thereon, the discharge chamber including a dividing wall disposed therein to form a first discharge zone and a second discharge zone therein; a first compression assembly disposed in the housing assembly in fluid communication with the first discharge zone of the discharge chamber through a first discharge conduit; and a second compression assembly disposed in the housing assembly in fluid communication with the second discharge zone of the discharge chamber through a second discharge conduit.

In another embodiment, the dual drive compressor comprises a housing assembly having a discharge chamber formed thereon, the discharge chamber formed on one of an upper portion and a side portion of the housing assembly, the discharge chamber including a dividing wall disposed therein, the wall having a first portion and a second portion forming a first discharge zone, a second discharge zone, and a third discharge zone, wherein the third discharge zone is disposed between and in fluid communication with the first discharge zone and the second discharge zone; a first compression assembly disposed in the housing assembly in fluid communication with the first discharge zone of the discharge chamber through a first discharge conduit that terminates at a bottom inner surface of the discharge chamber forming a first discharge inlet; a second compression assembly disposed in the housing assembly in fluid communication with the second discharge zone through a second discharge conduit that terminates at the bottom inner surface of the discharge chamber forming a second discharge inlet.

In another embodiment, the dual drive compressor for a refrigeration system comprises a housing assembly having a discharge chamber formed thereon adapted to receive a refrigerant, the discharge chamber formed on one of an upper portion and a side portion of the housing assembly, the discharge chamber including a dividing wall disposed therein, the wall having a first portion and a second portion forming a first discharge zone, a second discharge zone, and a third discharge zone, wherein the third discharge zone is disposed between and in fluid communication with the first discharge zone and the second discharge zone; a first compression assembly disposed in the housing assembly, the first compression assembly adapted to be driven by a mechanical input, the first compression assembly in fluid communication with the first discharge zone through a first conduit formed in the housing; a second compression assembly disposed in the housing assembly, the second compression assembly adapted to be driven by an electrical input, the second compression assembly in fluid communication with the second discharge zone through a second conduit formed in the housing.

BRIEF DESCRIPTION OF THE DRAWINGS

The above and other objects and advantages of the invention will become readily apparent to those skilled in the art from reading the following detailed description of the invention when considered in the light of the accompanying drawings, in which.

DETAILED DESCRIPTION OF THE PREFERRED EMBODIMENTS OF THE INVENTION

The following detailed description and appended drawings describe and illustrate an exemplary embodiment of the present invention. The description and drawings serve to enable one skilled in the art to make and use the invention, and are not intended to limit the scope of the invention in any manner. It is understood that materials other than those described can be used without departing from the scope and spirit of the invention.

Figure 1:
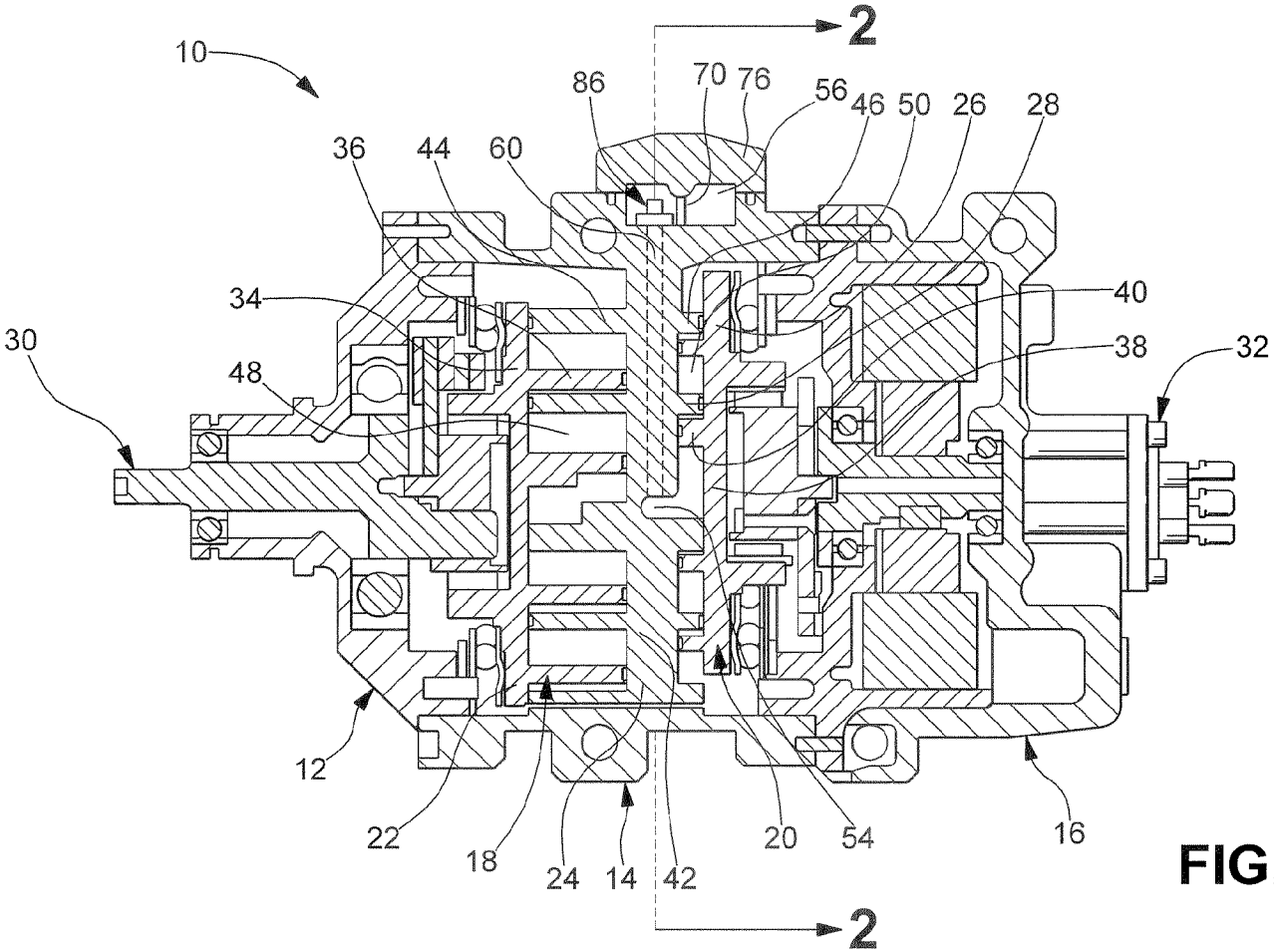
FIG. 1 is a cross-sectional view of a dual drive scroll compressor according to an embodiment of the invention.

FIG. 1 shows a dual drive scroll compressor 10 according to an embodiment of the invention. The compressor 10 includes a housing assembly having a first housing shell 12, a second housing shell 14, and a third housing shell 16. The first housing shell 12, the second housing shell 14, and the third housing shell 16 cooperate to form a hollow chamber therebetween. The housing shells 12, 14, 16 can be produced from any conventional material such as aluminum, for example. Although each of the housing shells 12, 14, 16 shown has a substantially circular cross-sectional shape, other cross-sectional shapes can be used as desired. The housing shells 12, 14, 16 can be joined using fasteners such as bolts, screws, clips, and the like, for example.

A first scroll assembly or a first compression assembly 18 and a second scroll assembly or a second scroll assembly 20 are disposed in the housing assembly. In the embodiment shown, the first scroll assembly 18 includes an orbit scroll 22 and a fixed scroll 24. The second scroll assembly 20 also includes an orbit scroll 26 and a fixed scroll 28.

In the embodiment shown, the orbit scroll 22 is driven by a mechanical input 30 such as a pulley system in mechanical communication with an engine of a vehicle, for example. The orbit scroll 26 is driven by an electrical input 32 such as an electric motor, for example. It is understood that the orbit scrolls 22, 26 can be driven by other sources if desired. It is further understood that the orbit scrolls 22, 26 can be independently operated, whereby operation of the orbit scroll 22 does not cause or depend on operation of the orbit scroll 26. As illustrated, the orbit scroll 22 includes an end plate 34 having a spiral involute 36 extending laterally outwardly therefrom. The orbit scroll 26 also includes an end plate 38 having a spiral involute 40 extending laterally outwardly therefrom.

In the embodiment shown, the fixed scrolls 24, 28 share an end plate 42 having a pair of spiral involutes 44, 46 extending laterally outwardly therefrom in opposing directions. The spiral involute 44 is adapted to receive and engage the spiral involute 36 formed on the end plate 34 of the orbit scroll 22 to define a plurality of compression chambers 48 therebetween. The spiral involute 46 is adapted to receive and engage the spiral involute 40 formed on the end plate 38 of the orbit scroll 26 to define a plurality of compression chambers 50 therebetween. It is understood that wraps of the involutes 36, 40, 44, 46 can be located and sized, as desired.

Figure 2:
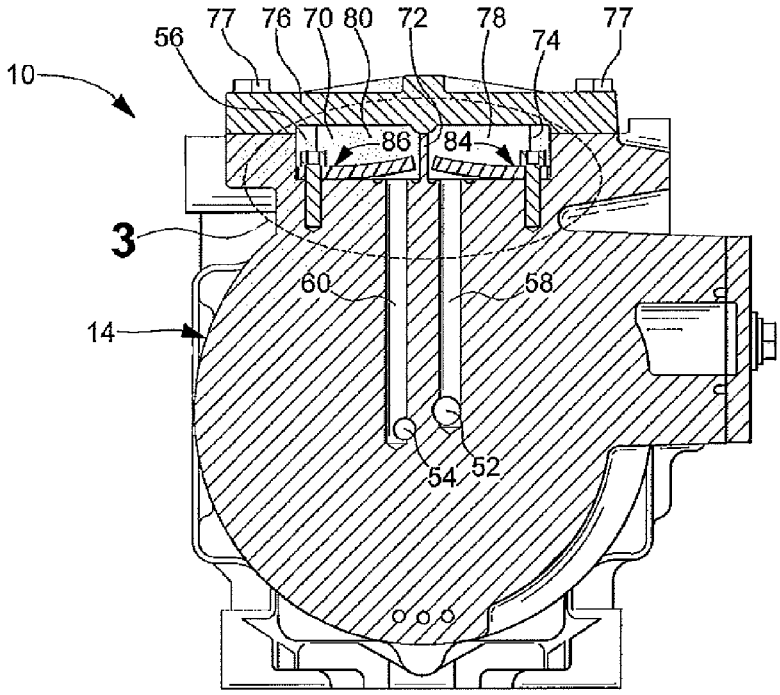
FIG. 2 is a cross-sectional view of the compressor illustrated in FIG. 1 taken along line 2-2.

The end plate 42 of the fixed scrolls 24, 28 includes a first discharge outlet 52, as shown in FIG. 2, and a second discharge outlet 54 formed therein. The first discharge outlet 52 is in fluid communication with the compression chambers 48 and a discharge chamber 56 through a first discharge conduit 58, as shown in FIG. 2. The second discharge outlet 54 is in fluid communication with the compression chambers 50 and the discharge chamber 56 through a second discharge conduit 60. The first discharge conduit 58 and the second discharge conduit 60 facilitate a flow of a fluid (not shown) such as an oil-refrigerant mixture, for example, from the compression chambers 48, 50 to the discharge chamber 56.

Figure 4:
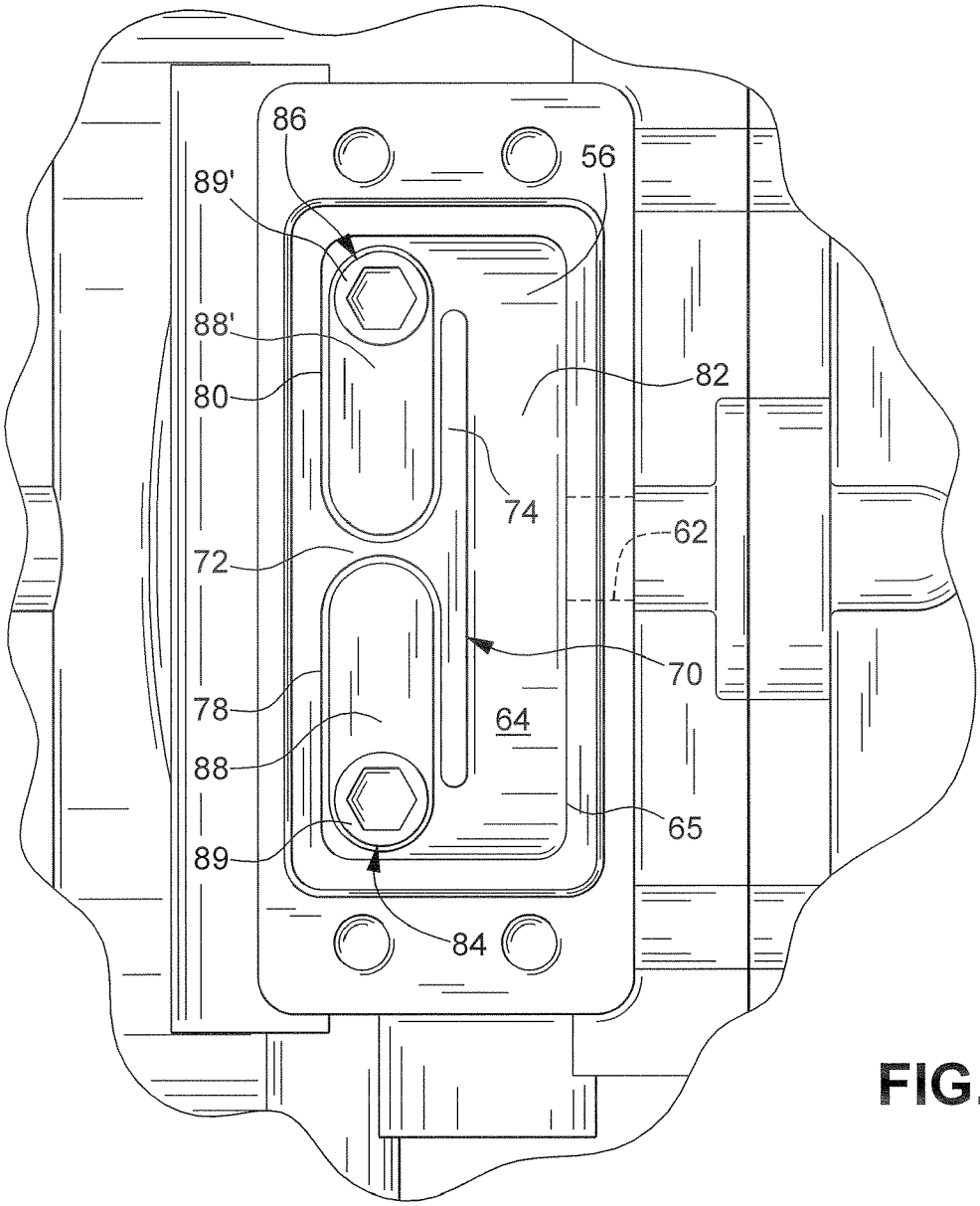
FIG. 4 is an enlarged fragmentary top plan view of the discharge chamber illustrated in FIG. 3.

In the embodiment shown, the discharge chamber 56 is formed on an upper portion of the second housing shell 14 between the first scroll assembly 18 and the second scroll assembly 20. It is understood that the discharge chamber 56 can be formed elsewhere on the compressor 10 as desired. It is also understood that the discharge chamber 56 can have any shape and size as desired. In the embodiment shown, the discharge chamber 56 is in fluid communication with a refrigeration system (not shown) through an exhaust port or exhaust conduit 62, as shown in FIG. 4. It is understood that the refrigeration system can be any conventional refrigeration system such as a heating, ventilating, and air conditioning system of a vehicle, for example.

Figure 3:
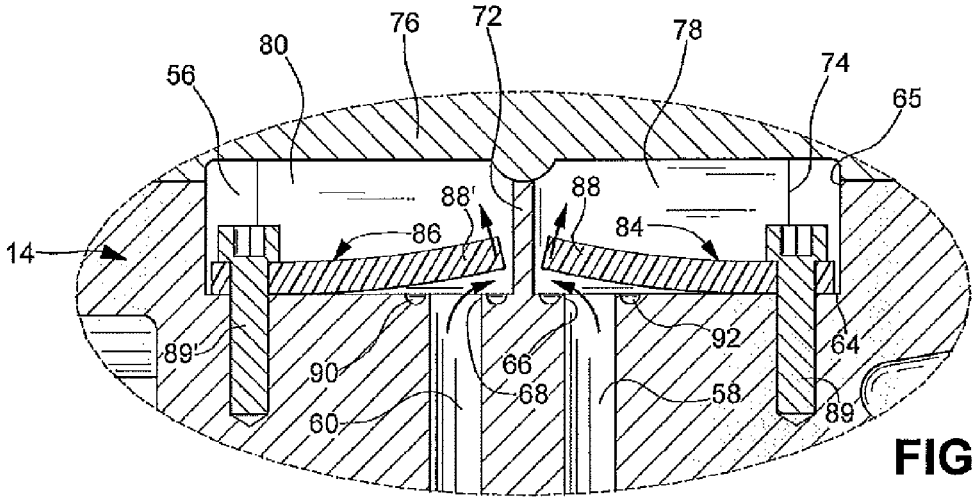
FIG. 3 is an enlarged fragmentary view of a discharge chamber highlighted by oval 3 in FIG. 2.

The discharge chamber 56, more clearly illustrated in FIGS. 2 to 4, includes a bottom inner surface 64 and an opposing open end 65. The first conduit 58 and the second conduit 60 terminate at the bottom inner surface 64 to form discharge inlets 66, 68, respectively, into the discharge chamber 56. A wall 70 is disposed within the discharge chamber 56. The wall includes a first section 72 and a second section 74 forming the generally T shaped wall 70. The wall 70 forms a first discharge zone 78, a second discharge zone 80, and a third discharge zone 82 within the discharge chamber 56.

A cover 76 is removably secured to the second housing shell 14 and covers the open end 65 of the discharge chamber 56. The cover 76 is adapted to sealingly engage the second housing shell 14 and an upper edge of the wall 70. It should be understood that fasteners 77 such as bolts, screws, clips, and the like, for example, can be employed to secure the cover 76 to the second housing shell 14. Additionally, it should be understood that sealing means such as an elastomeric material, for example, can be employed to facilitate forming a substantially fluid tight seal between the cover 76, and the second housing shell 14 and an upper edge of the wall 70.

Favorable results have been obtained by forming the first conduit 58 and the second conduit 60 wherein a longitudinal axis of the first conduit 58 is parallel to and aligned with a longitudinal axis of the second conduit 60. Accordingly, the longitudinal axes are substantially orthogonal in respect of the bottom inner surface 64 of the discharge chamber 56. This minimizes a length of the conduits 58, 60.

The first discharge zone 78 includes the first discharge inlet 66, and the second discharge zone 80 includes the second discharge inlet 68. The third discharge zone 82 is disposed between and is in fluid communication with the first discharge zone 78 and the second discharge zone 82. The exhaust conduit or exhaust port 62 is in fluid communication with the third discharge zone 82. Favorable results have been obtained by forming the exhaust port 62 equidistant from the discharge inlets 66, 68.

A first reed valve assembly 84 is disposed within the first discharge zone 78. The first reed valve assembly 84 is adapted to selectively form a substantially fluid tight seal between the first discharge inlet 66 and the first discharge zone 78. A second reed valve assembly 86 is disposed within the second discharge zone 80. The second reed valve assembly 86 is adapted to selectively form a substantially fluid tight seal between the second discharge inlet 68 and the second discharge zone 80. The reed valve assemblies 84, 86 each include an elongate member 88, 88', respectively, secured adjacent one end of the bottom surface 64 of the discharge chamber 56. The opposite end of the elongate members 88, 88' cover the respective discharge inlet 66, 68. It should be understood that fasteners 89, 89' such as bolts, screws, clips, and the like, for example, can be employed to secure the elongate members 88, 88' to the bottom surface 64 of the discharge chamber 56. The elongate members 88, 88' are adapted to flex, wherein the opposite end thereof is caused to move away from the bottom surface 64 of the discharge chamber 56 to allow a fluid to enter the discharge chamber 56 through the respective discharge inlets 66, 68.

A first groove or treepan 90 is formed in the first discharge zone 78 and a second groove or treepan 92 is formed in the second discharge zone 80. The grooves 90, 92 are formed around the discharge inlets 66, 68, respectively. The grooves 90, 92 are adapted to collect a fluid such as an oil, for example. Additionally, the grooves 90, 92 facilitate the forming of the fluid tight seal between the reed valve assemblies 84, 86 and the bottom surface 64 of the discharge chamber 56.

When the mechanical input 30 is in operation, the orbit scroll 22 of the first scroll assembly 18 is caused to revolve in a desired path, as is known in the art. The revolution of the orbit scroll 22 causes the spiral involute 36 of the orbit scroll 22 to cooperate with the spiral involute 44 of the fixed scroll 24, to compress the fluid flowing therethrough. The compressed fluid is then discharged from the compression chambers 48 of the first scroll assembly 18 through the first discharge outlet 52 into the first discharge conduit 58. The compressed fluid flows through the first discharge conduit 58 causing the elongate member 88 of the first reed valve 84 assembly to flex and move away from the discharge inlet 66, wherein the compressed fluid enters the first discharge zone 78 of the discharge chamber 56. From the first discharge zone 78, the compressed fluid flows into the third discharge zone 82 and into the refrigeration system through the exhaust conduit 62. The isolation of the first reed valve assembly 84 within the first discharge zone 78 and the separation of the first reed assembly 84 from the second reed valve assembly 86 within the third discharge zone 82 militates against the compressed fluid flowing from the first scroll assembly 18 interfering with the operation of the second scroll assembly 20.

Similarly, when the electrical input 32 is in operation, the orbit scroll 26 of the second scroll assembly 20 is caused to revolve in a desired path as is known in the art. The revolution of the orbit scroll 26 causes the spiral involute 40 of the orbit scroll 26 to cooperate with the spiral involute 46 of the fixed scroll 28, to compress the fluid flowing therethrough. The compressed fluid is then discharged from the compression chambers 50 of the second scroll assembly 20 through the second discharge outlet 54 into the second discharge conduit 60. The compressed fluid flows through the second discharge conduit 60 causing the elongate member 88' of the second reed valve assembly 86 to flex and move away from the discharge inlet 68, wherein the compressed fluid enters the second discharge zone 80 of the discharge chamber 56. From the second discharge zone 80, the compressed fluid flows into the third discharge zone 82 and into the refrigeration system through the exhaust conduit 62. The isolation of the second reed valve assembly 86 within the second discharge zone 80 and the separation of the second reed assembly 86 from the first reed valve assembly 84 within the third discharge zone 82 militates against the compressed fluid flowing from the second scroll assembly 20 interfering with the operation of the first scroll assembly 18.

Because each scroll assembly 18, 20 discharges the compressed fluid in the isolated discharge zones 78, 80, interference by discharge pulsations from the respective scroll assemblies 18, 20 and flow interference between the fluids discharged from the respective scroll assemblies 18, 20 are minimized. Accordingly, the typical negative effects associated with interference of discharge pulsations and flow interference such as an increase in noise generated by the scroll assemblies 18,20, reed valve flutter, and poor reed valve sealing, are also minimized. Additionally, the minimized flow interference causes an increase in the coefficient of performance of the dual drive scroll compressor 10 as compared to a dual drive scroll compressor of the prior art. The increased coefficient of performance of the present invention enables the use of a smaller dual drive scroll compressor to achieve a desired output of compressed fluid therefrom. The use of a smaller dual drive scroll compressor reduces the cost of the dual drive scroll compressor and the space occupied by the dual drive scroll compressor as compared to a dual drive scroll compressor of the prior art.

From the foregoing description, one ordinarily skilled in the art can easily ascertain the essential characteristics of this invention and, without departing from the spirit and scope thereof, can make various changes and modifications to the invention to adapt it to various usages and conditions in accordance with the scope of the appended claims.

What is claimed is:

1. A compressor comprising:

a housing assembly having a discharge chamber formed thereon, the discharge chamber including a substantially T-shaped dividing wall disposed therein to form a first discharge zone and a second discharge zone therein;

a first compression assembly disposed in the housing assembly in fluid communication with the first discharge zone of the discharge chamber through a first discharge conduit; and a second compression assembly disposed in the housing assembly in fluid communication with the second discharge zone of the discharge chamber through a second discharge conduit.

2. The compressor according to claim 1, wherein a longitudinal axis of the first discharge conduit and a longitudinal axis of the second discharge conduit are substantially orthogonal with a bottom inner surface of the discharge chamber.

3. The compressor according to claim 2, wherein the first discharge conduit and the second discharge conduit terminate at the bottom inner surface of the discharge chamber forming a first discharge inlet and a second discharge inlet, respectively.

4. The compressor according to claim 3, wherein a groove is formed in the bottom inner surface of the discharge chamber around at least one of the first discharge inlet and the second discharge inlet.

5. The compressor according to claim 3, wherein the wall is disposed between the first discharge inlet and the second discharge inlet.

6. The compressor according to claim 3, wherein the wall includes a first wall portion disposed between the first discharge inlet and the second discharge inlet, and a second wall portion integrally formed with the first wall portion.

7. The compressor according to claim 6, wherein the first wall portion and the second wall portion form the first discharge zone, the second discharge zone, and a third discharge zone within the discharge chamber, wherein the third discharge zone is disposed between and in fluid communication with the first discharge zone and the second discharge zone.

8. The compressor according to claim 7, further comprising an exhaust conduit formed in the housing, the exhaust conduit in fluid communication with the third discharge zone.

9. The compressor according to claim 7, further comprising at least one valve assembly disposed in at least one of the discharge zones.

10. The compressor according to claim 9, wherein the valve assembly is a reed type valve.

11. The compressor according to claim 1, wherein one of the first compression assembly and the second compression assembly is adapted to be driven by a mechanical input, and one of the first compression assembly and the second compression assembly is adapted to be driven by an electrical input.

12. A dual drive compressor comprising:

a housing assembly having a discharge chamber formed thereon, the discharge chamber formed on one of an upper portion and a side portion of the housing assembly, the discharge chamber including a substantially T-shaped dividing wall disposed therein, the wall having a first portion and a second portion forming a first discharge zone, a second discharge zone, and a third discharge zone, wherein the third discharge zone is disposed between and in fluid communication with the first discharge zone and the second discharge zone;

a first compression assembly disposed in the housing assembly in fluid communication with the first discharge zone of the discharge chamber through a first discharge conduit that terminates at a bottom inner surface of the discharge chamber forming a first discharge inlet; and a second compression assembly disposed in the housing assembly in fluid communication with the second discharge zone through a second discharge conduit that terminates at the bottom inner surface of the discharge chamber forming a second discharge inlet.

13. The compressor according to claim 12, wherein the first wall portion is disposed between the first discharge inlet and the second discharge inlet, and the second wall portion is integrally formed with the first wall portion.

14. The compressor according to claim 12, further comprising an exhaust conduit formed in the housing, the exhaust conduit formed in a wall defining the third discharge zone of the discharge chamber.

15. The compressor according to claim 12, further comprising a first reed valve assembly disposed within the first discharge zone, and a second reed valve assembly disposed within the second discharge zone.

16. The compressor according to claim 15, wherein a groove is formed in the bottom surface of the discharge chamber around at least one of the first discharge inlet and the second discharge inlet.

17. A dual drive compressor for a refrigeration system comprising:

a housing assembly having a discharge chamber formed thereon adapted to receive a refrigerant, the discharge chamber formed on one of an upper portion and a side portion of the housing assembly, the discharge chamber including a substantially T-shaped dividing wall disposed therein, the wall having a first portion and a second portion forming a first discharge zone, a second discharge zone, and a third discharge zone, wherein the third discharge zone is disposed between and in fluid communication with the first discharge zone and the second discharge zone;

a first compression assembly having a plurality of compression chambers disposed in the housing assembly, the first compression assembly adapted to be driven by a mechanical input, the compression chambers in fluid communication with the first discharge zone through a first conduit formed in the housing; and a second compression assembly having a plurality of compression chambers disposed in the housing assembly, the second compression assembly adapted to be driven by an electrical input, the compression chambers in fluid communication with the second discharge zone through a second conduit formed in the housing.

18. The compressor according to claim 17, further comprising a first reed valve assembly disposed within the first discharge zone adapted to selectively form a substantially fluid tight seal between the first discharge conduit and the first discharge zone, and a second reed valve assembly is disposed within the second discharge zone adapted to selectively form a substantially fluid tight seal between the second discharge conduit and the second discharge zone.

19. The compressor according to claim 18, wherein the reed valve assemblies cooperate with the discharge zones to attenuate discharge pulsations caused by the refrigerant received in the discharge chamber.

20. The compressor according to claim 17, wherein a longitudinal axis of the first discharge conduit is substantially parallel to and aligned with a longitudinal axis of the second discharge conduit, the longitudinal axes substantially orthogonal with a bottom inner surface of the discharge chamber to minimize the length of the first and second conduit.

* * * * *